United States Patent [19]

Alford et al.

[11] 4,325,810

[45] Apr. 20, 1982

[54] DISTILLATE YIELDS BY CATALYTICALLY CO-COKING SHALE OIL AND PETROLEUM RESIDUA

[75] Inventors: Harvey E. Alford, Amherst; Robert A. Rightmire, Northfield, both of Ohio

[73] Assignee: The Standard Oil Company, Cleveland, Ohio

[21] Appl. No.: 80,832

[22] Filed: Oct. 1, 1979

[51] Int. Cl.[3] ..... C10G 1/06; C10G 11/02; C10G 45/16

[52] U.S. Cl. ..... 208/112; 208/11 R; 208/46; 208/107; 208/113

[58] Field of Search ..... 208/108, 112, 11 R, 208/39, 46, 107, 113, 114, 50–61, 106–127, 11 LE

[56] References Cited

U.S. PATENT DOCUMENTS

| | | | |
|---|---|---|---|
| 2,727,853 | 12/1955 | Hennig | 208/51 X |
| 2,844,520 | 7/1958 | Viland | 208/114 |
| 2,885,350 | 5/1959 | Brown et al. | 208/127 |
| 2,888,395 | 5/1959 | Henny | 208/111 |
| 2,953,518 | 9/1960 | McKinley et al. | 208/127 |
| 3,131,142 | 4/1964 | Mills | 208/108 |
| 3,475,323 | 10/1969 | Stuckey et al. | 208/97 |
| 3,537,975 | 11/1970 | Blaser | 208/50 |
| 3,663,429 | 5/1972 | Vallino | 208/108 |
| 3,891,538 | 6/1975 | Walkey | 208/50 |
| 4,133,742 | 1/1979 | Hill | 208/11 R |
| 4,169,041 | 9/1979 | Schuette | 208/108 |
| 4,204,943 | 5/1980 | Metrailer et al. | 208/50 |
| 4,224,140 | 9/1980 | Fujimori et al. | 208/124 |

*Primary Examiner*—Delbert E. Gantz
*Assistant Examiner*—G. E. Schmitkons
*Attorney, Agent, or Firm*—William A. Heidrich; Herbert D. Knudsen; Larry W. Evans

[57] ABSTRACT

Liquid product yields produced by coking a mixture of a shale oil residuum and a petroleum residuum are improved by including in the feed to be coked a hydrogen catalyst.

15 Claims, No Drawings

DISTILLATE YIELDS BY CATALYTICALLY CO-COKING SHALE OIL AND PETROLEUM RESIDUA

BACKGROUND OF THE INVENTION

The present invention relates to an improved technique for coking mixtures of petroleum residua and shale oil residua and in particular to an improvement over commonly assigned application Ser. No. 080,830, filed Oct. 1, 1979.

In prior application Ser. No. 080,830, the disclosure of which is incorporated herein by reference, it was disclosed that liquid product yields produced by coking can be unexpectedly increased by the expedient of using as the coking feed a mixture of a shale oil residuum and a petroleum residuum. Since liquid products produced by coking are generally more valuable than the solid coke product, this invention has significant commercial advantage.

However, it would be even more valuable if the liquid product yields could be increased over and above the amounts realized when a mixture of shale oil residuum and petroleum residuum is coked in accordance with that invention, and accordingly it is an object of the present invention to provide a process for coking a mixture of shale oil residuum and petroleum residuum which is capable of producing even greater liquid yields.

SUMMARY OF THE INVENTION

These and other objects are accomplished by the present invention in accordance with which a hydrogen catalyst is included in the shale oil residuum/petroleum residuum mixture subjected to the coking operation. In accordance with the present invention, it has been found that suitable catalytic materials will catalyze the addition of greater amounts of hydrogen to the organics in the feed stream thereby in effect causing greater amounts of liquid products to be obtained. Consequently, in accordance with the inventive process the overall liquid yield is greater than when the coking operation is accomplished in the absence of such catalysts.

Thus the present invention provides an improvement over the previously described process for producing coke and a liquid product from a feed material comprising a mixture of a shale oil material and a petroleum residuum, the improvement in accordance with the present invention comprising including in the feed a hydrogen catalyst.

DETAILED DESCRIPTION

The coking procedure to be followed in accordance with the present invention, the types of petroleum streams and shale oil streams that can be processed in accordance with the present invention, and the relative amount of the shale oil streams and petroleum streams in the feed material in accordance with the present invention are all the same as those described in the aforementioned application Ser. No. 080,830.

In accordance with the present invention, a suitable catalyst is included in the feed introduced into the coker. As suitable catalysts, any material which will catalyze the reaction of hydrogen (be it molecular, atomic or combined) with free radical organic compounds and/or unsaturated organic compounds can be used. Such catalysts are referred to herein as "hydrogen catalysts."

Many types of hydrogen catalysts are known. One well known type of hydrogen catalyst is referred to in the art as a hydrogen transfer catalyst. Hydrogen transfer catalysts are known to catalyze the addition of molecular or combined hydrogen to a free radical organic compound, usually a hydrocarbon. Such catalysts are normally used in co-liquefaction when combined hydrocarbon from one organic compound is transferred to another free radical organic compound. Examples of known hydrogen transfer catalysts are iron pyrites and alkaline iron oxide.

The second type of hydrogen catalysts that can be employed in the inventive process is known in the art as a "hydrogenation catalyst." Such catalysts are normally used to add molecular hydrogen across an unsaturated double bond, although they can also be used for hydrogenating aromatically unsaturated compounds. Well known examples of this type of catalysts are metallic nickel, platinum and palladium.

A third and preferred type of hydrogen catalyst useful in the inventive process is known as a "hydrocracking catalyst." Such catalysts are normally used in petroleum refining and function both to cleave a large organic molecule into smaller organic molecules and at the same time to add hydrogen to each of the sites where the break occurred. Examples of well known hydrocracking catalysts are NiMo, CoMo, NiW and CoW. Preferred hydrocracking catalysts are NiW and NiMo. Such catalysts are usually supported on alumina supports.

It has also been found that the sulfur and nitrogen contents of process feed materials are usually reduced when a catalyst is used in accordance with the present invention.

Amount of Catalyst

The amount of catalyst employed in the inventive process is not critical and can vary between wide limits. From an economic feasibility standpoint, the amount of catalyst should probably be no more than about 10 weight percent based on the weight of coker feed, and consequently the amount of catalyst in the feed material will normally be between greater than 0 to 10 percent by weight. The preferred amount of catalyst is 0.01 to 5 weight percent with the most preferred amount of catalyst being 0.05 to 1 weight percent.

Mixing

It is preferred that the coking operation be carried out so that the catalyst is at least partially mixed with the feed material undergoing coking. In this regard, it has been noticed in using a laboratory scale batch coker that the catalysts will normally settle to the bottom of the coker if the liquid therein is quiescent. Thus, if coking is accomplished in a strictly batch operation, it is preferrable to mix the liquid in the coker during the coking operation so that the catalysts will be distributed throughout the mass of liquid undergoing coking. Mixing can be accomplished by any conventional means such as using a mechanical mixer or passing an inert gas through the liquid.

Commercially, coking is usually accomplished in a semi-batch operation wherein liquid feed is continuously fed to the "delayed coker" and liquid products continuously removed from the coker. The liquid fed in the coker during the coking operation continues to be converted to coke and liquid product until the coker substantially fills with solid coke at which time the coking operation is terminated. In such an operation, feeding the liquid feed to the coker inherently causes enough mixing to provide reasonable distribution of the catalyst in the liquid feed being coked.

Catalyst Recycle

In accordance with one feature of the inventive process, catalysts which have been previously used in the inventive process can be recycled for reuse. This can be accomplished in two ways. In accordance with one technique, coke product containing the catalyst thereinafter suitable comminution can itself be returned to the coker with fresh feed. In accordance with the other technique, coke product containing the catalyst therein is subjected to combustion, thereby freeing the catalyst in the form of an ash by-product. This ash by-product can then be returned to the coker with fresh feed. Recycling of catalyst has the obvious advantage of reducing the total amount of catalyst required.

WORKING EXAMPLES

In order to more thoroughly describe the present invention, the following working examples are presented. In each of these examples, a mini-coker as described in the aforementioned application Ser. No. 080,830 was used. In carrying out the examples, the catalyst was first pulverized (particle size less than 100 mesh) and then mixed with the feed material prior to its introduction into the coker. The pressure was varied from 0 to 90 psig, which is the normal range of operation for a commercial delayed coker. The coker was then heated to elevated temperature in accordance with the programmed temperature cycle shown in the following Table I.

TABLE I

Time at Temperature in the Mini-Coker

| Temp., °F. | Time, Minutes |
|---|---|
| 600 | 45 |
| 800 | 45 |
| 900 | 30 |
| 1,000 | 30 |
| 1,100 | 30 |
| 1,200 | 90 |

In order to prevent condensation and reflux of a liquid product, the outlet line of the mini-coker was heated to 650° F. prior to the start of each test. The volume of the offgas was measured and samples were taken at regular intervals for analysis. In the tests where a catalyst was used, its weight was not included in the material balance calculations. Since the volatile matter remaining in the coke could vary over wide limits, the yield of coke was calculated on a 0 VCM (volatile carbonaceous matter) basis. This volatile matter was included in the liquid product as was the $C_{4+}$ material in the gas stream for material balance purposes.

EXAMPLES 1 AND 2 AND COMPARATIVE EXAMPLE A

Three catalyst types were tested for their effect on liquid product yields. These were a fluid catalytic cracking catalyst, a hydrogen transfer catalyst and a hydrocracking catalyst. In these tests, no effort was made to keep the catalyst suspended during the cracking process. The identity of the catalyst, the composition of the feed, other variables and the results obtained are set forth in the following Table II.

TABLE II

Effect of Catalyst Type on Product Yield and Sulfur and Nitrogen Contents

Feed: 50% Whole Shale oil, 50% Vacuum Tower Bottoms
Catalyst Concentration: 1.0 wt. % of feed
Pressure: 25 psig

| | Catalyst | | Product Yields, Wt. % | | Total Product S&N Contents Wt % | |
|---|---|---|---|---|---|---|
| Example | Type | Composition | Liquid, $C_{4+}$ | Coke* (0 VCM) | S | N |
| Comp A | None | — | 63.23 | 23.36 | 1.79 | 1.58 |
| Comp B | FCC | | 63.03 | 26.82 | 1.65 | 1.63 |
| 1 | H Transfer | Iron Pyrites | 64.79 | 24.67 | 1.64 | 1.50 |
| 2 | Hydrocrack | | 67.16 | 22.56 | 1.66 | 1.24 |

*Catalyst weight not included.

From the above Table II, it can be seen that the amount of liquid yields produced when a hydrogen transfer catalyst or a hydrocracking catalyst are included in the feed material is significantly above the yield obtained when no catalyst or a catalyst not having a hydrogenation capability, i.e. a conventional fluid catalytic cracking catalyst, are used.

EXAMPLES 3 AND 4

The laboratory scale coking apparatus used in the foregoing examples was modified so that a gas could be tangentially introduced at its base to ensure that the catalyst remains suspended during coking. Example 2 was repeated twice, in one instance nitrogen gas being fed at a rate of about 0.02 ft.$^3$/minute to the coker and in the other instance no nitrogen being fed to the coker. The results obtained are set forth in the following Table III.

TABLE III

Effect of Keeping the Catalyst Suspended with Nitrogen

50% Whole Shale Oil
50% Vacuum Bottoms
1% Hydrocracking Catalyst, Based on Feed
25 Psig

| | Example 3 Catalyst Suspended | Example 4 Catalyst Not Suspended |
|---|---|---|
| Products | | |
| Liquid ($C_{4+}$), Wt. % | 72.84 | 67.91 |
| Coke (0 VCM)*, Wt. % | 20.24 | 19.48 |
| Total Products | | |
| S, Wt. % | 1.70 | 1.56 |
| N, Wt. % | 1.50 | 1.73 |

*Catalyst weight not included.

From the above table, it can be seen that mixing of the liquid feed undergoing coking to ensure a reasonable distribution of the catalysts therein causes liquid products to be produced in even higher yields.

EXAMPLES 5 TO 9 AND COMPARATIVE EXAMPLE C

Five different hydrocracking catalysts were used in the inventive process. The conditions of use as well as the results obtained are set forth in the following Table IV.

TABLE IV

Effect of Hydrocracking Catalyst Type Suspending Gas: Nitrogen (25 psig)

50% Whole Shale oil
50% Vacuum Bottoms
Catalyst Concentration: 1 Wt. % Based on Feed

| Example | Catalyst* | Product Yields, Wt. % Liquid ($C_4$+) | Product Yields, Wt. % Coke** (O VCM) | Total Product S&N Wt. % S | Total Product S&N Wt. % N |
|---|---|---|---|---|---|
| 5 (3)*** | 4.1% Ni 13.3% Mo | 72.84 | 20.24 | 1.70 | 1.50 |
| 6 | 2.7% Ni 50.3% W | 71.44 | 18.71 | 1.73 | 1.58 |
| 7 | 2.9% Ni 17.5% Mo | 70.73 | 19.48 | 1.76 | 1.54 |
| 8 | 5.8% Ni 27.2% W | 72.39 | 24.01 | 1.94 | 1.60 |
| 9 | 6.6% Ni 29.1% W | 70.43 | 19.39 | 1.87 | 1.52 |
| Comp. C | None | 70.26 | 18.75 | 1.72 | 1.64 |

*Wt. %, all catalysts supported on $SiO_2$ stabilized alumina.
**Catalyst weight not included.
Same run as Example 3 of Table III From the above Table IV, it can be seen that all the hydrocracking catalysts provide improvement in the yields of liquid product obtained. Moreover, hydrocracking catalysts of the NiW type (Examples 5 and 8) show an excellent increase in the amount of liquid product yields.

EXAMPLES 10 TO 12

In order to determine the effect of pressure on the inventive process, three additional examples were conducted using the hydrocracking catalyst of Example 5. The conditions of the examples as well as the results obtained are set forth in the following Table V.

TABLE V

Effect of Pressure Suspending Gas: Nitrogen

50% Whole Shale Oil
50% Vacuum Bottoms
Hydrocracking Catalyst Concentration: 1 wt. %

| Example | 10 | 11 | 12 |
|---|---|---|---|
| Pressure, psig | 25.00 | 50.00 | 90.00 |
| Wt. % Liquid ($C_4$+) | 72.84 | 72.13 | 70.07 |
| Wt. % Coke* (0 VCM) | 20.24 | 19.19 | 21.86 |
| Total Product | | | |
| S, Wt. % | 1.70 | 1.76 | 1.87 |
| N, Wt. % | 1.50 | 1.54 | 1.42 |

*Catalyst weight not included.

As can be seen from the above table, improved liquid yields are obtained over the entire conventional range of commercial coking operations, i.e. about 25 to 90 psig.

EXAMPLES 13 TO 17 AND COMPARATIVE EXAMPLES D AND E

In order to determine the effect of feed composition on the liquid product yields, an additional series of experiments was conducted. In these experiments, the ratio between the shale oil component and the petroleum component of the feed were varied, these examples using the hydrocracking catalyst of Example 5 present in an amount of 1% by weight in each feed. The conditions of the examples as well as the results obtained are set forth in the following Table VI.

TABLE VI

Effect of Feed Composition on Liquid Yield Suspending Gas: $N_2$

1% Hydrocracking Catalyst
25 Psig

| Example | Feed Composition, Wt. % Shale Oil | Feed Composition, Wt. % Vacuum Bottoms | Liquid ($C_4$+) Yield, Wt. % Experimental | Liquid ($C_4$+) Yield, Wt. % Calculated | Liquid ($C_4$+) Yield, Wt. % E-C | Feed Composition Wt. % Shale Oil | Feed Composition Wt. % Vacuum Bottoms |
|---|---|---|---|---|---|---|---|
| Comp D | 0.00 | 100.00 | 57.41 | — | — | 0.00 | 100.00 |
| 13 | 10.24 | 89.76 | 62.27 | 59.94 | 2.33 | 10.24 | 89.76 |
| 14 | 25.26 | 74.74 | 69.20 | 63.64 | 5.56 | 25.26 | 74.74 |
| 15 | 50.00 | 50.00 | 72.84 | 69.74 | 3.10 | 50.00 | 50.00 |
| 16 | 74.37 | 25.63 | 78.11 | 75.75 | 2.36 | 74.37 | 25.63 |
| 17 | 88.87 | 11.13 | 78.62 | 79.33 | −0.71 | 88.87 | 11.13 |
| Comp E | 100.00 | 0.00 | 82.07 | — | — | 100.00 | 0.00 |

From the foregoing, it can be seen that the greatest increase in the amount of liquid products obtained is when the shale oil component of the feed is about 25 wt. %, the same optimal amount of shale oil feed in the aforementioned Ser. No. 080,830.

Although only a few embodiments of the present invention have been described above, many modifications can be made without departing from the spirit and scope of the invention. All such modifications are intended to be included within the scope of the present invention, which is to be limited only by the following claims.

We claim:

1. In a process wherein a feed material comprising a mixture of a shale oil material and a petroleum material are heated in the substantial absence of oxygen to produce coke and a liquid product, the improvement wherein said feed material contains a hydrogen catalyst selected from the group consisting of hydrogen transfer catalysts, hydrogenation catalysts, and hydrocracking catalysts.

2. The process of claim 1 wherein said feed material contains from greater than 0 to 10 weight % hydrogen catalyst.

3. The process of claim 2 wherein said feed material contains from 0.01 to 5 weight percent hydrogen catalyst.

4. The process of claim 1 wherein said hydrogen catalyst is a hydrogen transfer catalyst.

5. The process of claim 4 wherein said hydrogen transfer catalyst is selected from the group consisting of iron pyrites.

6. The process of claim 1 wherein said hydrogen catalyst is a hydrogenation catalyst.

7. The process of claim 6 wherein said hydrogenation catalyst is selected from the group consisting of metallic nickel, platinum and palladium.

8. The process of claim 1 wherein said hydrogen catalyst is a hydrocracking catalyst.

9. The process of claim 8 wherein said hydrocracking catalyst is selected from the group consisting of NiMo, CoMo, NiW and CoW.

10. The process of claim 9 wherein said hydrocracking catalyst includes an alumina support.

11. The process of claim 1 wherein said feed material containing said hydrogen catalyst is mixed during coking.

12. The process of claim 1 further comprising withdrawing coke from the reaction zone wherein coking has occurred, mixing the hydrogen catalyst contained in said coke with additional feed material and subjecting said additional feed material to coking.

13. The process of claim 12 wherein coke passing out of said reaction zone is combusted so that said hydrogen catalyst is recovered in the form of an ash and said ash is mixed with said additional feed material.

14. The process of claim 12 wherein coke removed from said reaction zone is mixed with said additional feed material.

15. In a process wherein a feed material comprising a mixture of a shale oil material and a petroleum material consisting of petroleum derived residua are heated in the substantial absence of oxygen to produce coke and a liquid product, the improvement wherein said feed material contains a hydrogen catalyst selected from the group consisting of hydrogen transfer catalysts, hydrogenation catalysts, and hydrocracking catalysts.

* * * * *